United States Patent [19]

Minagawa

[11] Patent Number: 4,499,620

[45] Date of Patent: Feb. 19, 1985

[54] FOAM WASHING METHOD

[75] Inventor: Motoi Minagawa, Ashiya, Japan

[73] Assignee: Takasago Perfumery Co., Ltd., Tokyo, Japan

[21] Appl. No.: 453,906

[22] Filed: Dec. 28, 1982

[30] Foreign Application Priority Data

Feb. 23, 1982 [JP] Japan ..... 57-27797

[51] Int. Cl.[3] ..... D06F 17/12

[52] U.S. Cl. ..... 8/158; 8/477

[58] Field of Search ..... 68/183, 5 C, 18 R; 8/158, 149.1, 149.2, 137, 477; 55/178, 87; 15/32; 134/102, 105, 108; 252/173

[56] References Cited

U.S. PATENT DOCUMENTS

| | | | |
|---|---|---|---|
| 1,771,436 | 7/1930 | Guett | 134/102 |
| 1,948,568 | 2/1934 | Faber et al. | 68/5 C |
| 2,194,607 | 3/1940 | McDevitt | 134/102 X |
| 2,226,870 | 12/1940 | McDevitt | 134/102 |
| 3,298,615 | 1/1967 | Echols | 55/178 X |
| 3,697,314 | 10/1972 | Stritzko | 8/477 |
| 4,118,189 | 10/1978 | Reinwald et al. | 8/137 |
| 4,275,656 | 6/1981 | Choma | 8/151 X |
| 4,314,804 | 2/1982 | Fennekels et al. | 8/137 |
| 4,326,904 | 4/1982 | Eckert et al. | 8/477 X |

FOREIGN PATENT DOCUMENTS

| | | | |
|---|---|---|---|
| 430684 | 6/1935 | United Kingdom | 68/183 |
| 47909 | 9/1979 | U.S.S.R. | 55/178 |
| 48001 | 1/1980 | U.S.S.R. | 55/87 |

OTHER PUBLICATIONS

"Coalescence In Dense Packed Gas/Liquid and Liquid/Liquid Dispersion", by S. Hartland, (1981).

*Primary Examiner*—Philip R. Coe
*Assistant Examiner*—Frankie L. Stinson
*Attorney, Agent, or Firm*—Oblon, Fisher, Spivak, McClelland & Maier

[57] ABSTRACT

A foam washing method which comprises forming a large amount of foams by blowing a gas through a concentrated aqueous solution of a detergent, and thereafter bringing said foams into contact with soiled textile goods to separate and remove dirts adhered to fibers of said textile goods.

8 Claims, 7 Drawing Figures

FOAM WASHING METHOD

FIELD OF THE INVENTION

The present invention relates to a novel washing method of the type of economizing resources and energy, which is completely different from the conventional washing method of the type of immersing in water. More particularly, it relates to a novel washing method in which dirts are separated and removed from textile goods utilizing foams formed from a concentrated aqueous solution of a detergent without using water or organic solvents as a medium.

BACKGROUND OF THE INVENTION

Hitherto, washing of clothing has been carried out generally by immersing the clothing in a washing solution prepared by dissolving a detergent in cool water or hot water and mechanically stirring by means of a washing machine. Such a washing method of the type of immersing in water requires to use water and detergent in large amounts of 20 to 30 l water and 40 to 50 g the detergent per kg of the clothing, because the clothing should be completely immersed in the washing solution.

However, in the recent years, with an increase of population, water tends to be in short supply, and pollution of the quality of water caused by waste washing solution becomes a big social problem due to insufficient waste water disposal plants.

SUMMARY OF THE INVENTION

As a result of extensive studies under such circumstances to develop a washing method capable of effectively washing textile goods using small amounts of water and detergents, there has been developed a washing method of the type with a ultralow bath ratio and a high concentration of foams which is completely different from the conventional washing method of the type of immersing in water.

Accordingly, an object of the present invention is to provide a method of washing soiled textile goods effectively with very small amounts of water and a detergent, which comprises forming a large amount of foams by blowing a gas through a concentrated aqueous solution of a detergent and bringing the foams into contact with the textile goods to separate and remove dirts attaching to fibers.

DETAILED DESCRIPTION OF THE INVENTION

The textile goods which can be treated with the method of the present invention can be composed of any natural fibers and synthetic fibers. Any shapes such as fibrous form, yarns, cloths such as woven cloth or knitting cloth, nonwoven cloths, processed goods, etc., can be used.

The detergents used in the present invention can be suitably selected from natural and synthetic detergents conventionally used for washing. Of those detergents, soaps such as alkali metal salts of higher aliphatic acid or foamable detergents such as ethylene oxide adduct of amide are particularly preferred. These detergents are used in the form of an aqueous solution having a far higher concentration, for example, a concentration of 0.3 to 1.0 wt%, than the case of conventional washing. The aqueous solution can be used at room temperature, but it is advantageous to use it with heating to 40° to 70° C. because washing efficieny is remarkably improved.

As is different from the case of the conventional method of immersing in water, since the wash is not necessarily completely immersed in the wash solution, it is sufficient in the present invention to use the concentrated aqueous solution of the detergent in an amount of 1 to 2 l based on 1 kg of the washing.

It is necessary in the present invention to form foams by blowing a gas through the concentrated aqueous solution of the detergent. As the gas used, air is most preferred. Air heated to 40° to 80° C. or more is particularly advantageous to form high temperature foams having high washing ability.

In addition, inert gases such as nitrogen, carbon dioxide, etc., can be used. Hot waste gases generated in various industrial fields can be also used.

The contact time between foams and the wash in the present invention is about 5 to 10 minutes, which is fairly shorter than 10 to 15 minutes in the conventional washing method of the type of immersing in water. Further, the amount of washing water adhered to and remained on the wash is so small that rinsing can be completely carried out by showering only one time with 15 to 20 l of washing water, though the conventional method requires rinsing at least two times with 100 to 110 l of washing water.

It is advantageous in the present invention that the concentrated aqueous solution of the detergent is regenerated by subjecting the foams after use for washing by bringing into contact with the wash, to a defoaming treatment, and then recycled the solution for reuse. This defoaming treatment can be carried out, for example, by bringing the foams into contact with a heated metal plate. In this treatment, since microorganisms such as bacteria or molds adhering to the wash and migrating into foams are killed by heating the metal plate to 100° C. or more, there is an advantage that sterilization can be carried out simultaneously with washing.

A preferred embodiment of the method of the present invention is explained by reference to the accompanying drawings.

Figure 1:
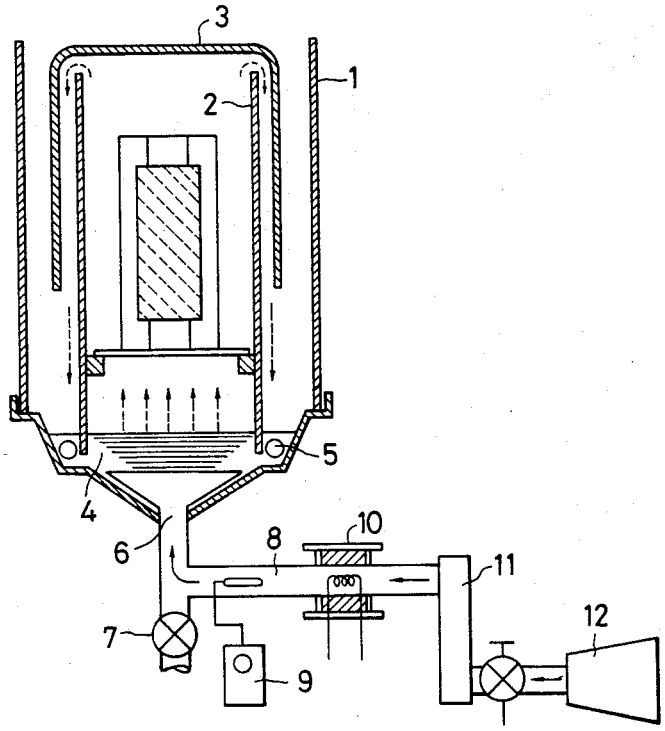
FIG. 1 is a cross-sectional view of one example of washing machines suitable to perform the method of the present invention, wherein 1 is an outer cylinder, 2 is an inner cylinder, 3 is a heating metal plate for defoaming and 4 is a reservoir for a washing solution.

FIG. 1 is a cross-sectional view showing one example of washing machines used in the method of the present invention. This washing machine is made up of a washing container comprising an inner cylinder 2 disposed in the inside of an outer cylinder 1, a heated metal plate cover 3 for defoaming provided on the top of the inner cylinder, and the bottom which is a reservoir 4 for the concentrated aqueous solution, a heater 10 for the gas which is connected with a pipe 8 communicating with a blowing opening 6 on the bottom of the washing container, and a motor 12 for blowing the gas.

Washing of clothing using the washing machine having such a structure is conducted in the following manner.

The clothing is introduced into the inside of the inner cylinder 2, and the reservoir 4 is filled with a soap solution having a concentration of 0.3 to 1.0 wt% which is heated to 30° to 70° C. by a heater 5. Then, the motor 12 is driven, and air at a rate previously controlled by a flow meter is blown through the soap solution from the blowing opening 6 at a rate of 20 to 40 l/minute while adjusting the temperature of air to 30° to 80° C. by a heater 10 and a thermostat 9. By this treatment, a large amount of foam or foams are continuously formed. The forms gradually rise in the inner cylinder 2, contact the clothing filled therein to separate dirts adhering thereto, and reach to the heating metal plate 3 at the top while carrying the dirt. When the foams contact the heating metal plate 3, they are broken to become the soap solution again and the solution falls down along the outside wall of the inner cylinder 2 and returns to the reservoir 4. After washing for 5 to 10 minutes, the blowing motor 12 is stopped, a valve 7 in the bottom portion of the washing container is opened, and rinsing is carried out by scattering water from a shower (not shown in the drawing) arranged at the upper portion. It is sufficient that the amount of water necessary for washing and rinsing is about 1/5 time the amount of water required in the conventional washing machine and about ¼ the amount of water required in a water economizing type washing machine.

By the above treatment, since foams containing soap in a high concentration are brought into contact with the clothing and a part of foams are broken to produce a soap solution having a high concentration, by which the clothing is wetted, washing can be carried out with a very high efficiency. Further, since the foams and the soap solution regenerated therefrom are heated to 30° C. or more, those have a high ability to solubilize oil stains and, consequently, oils and fats or proteins adhering to underwares, etc., which are difficult to remove can be easily liquefied and removed.

Further, since the foams generally have a high absorbing property, dirts and particles separated from the clothing are carried away outside the system by being supported on the foams. Accordingly, dirt and particles once separated do not contact the clothing again and there is no possibility of resoiling as in the conventional washing.

As described above, the method of the present invention has the following advantages.

(1) The amounts of water and the detergent can be greatly economized and, consequently, the amount of waste solution can be remarkably reduced.

(2) Damages of clothing are hardly observed since mechanical friction does not involve during washing.

(3) Noises can be remarkably reduced due to unnecessity of using a motor for mechanical agitation.

(4) A washing effect is improved and a sufficient whitening can be achieved due to no possibility of resoiling.

(5) Sterilization treatment can be carried out simultaneously with washing by using a heated aqueous solution of the detergent.

In the following, the present invention is illustrated in greater detail by reference to examples, but the present invention is not limited to the examples. Unless otherwise indicated, all percents, parts, ratios and the like are by weight.

EXAMPLE 1

Using a washing machine having the structure as shown in FIG. 1, a neck-soiled cloth (naturally soiled cloth) was washed with foams for 5 to 30 minutes with a 0.5% aqueous solution of sodium palmitate adjusted to 70° C. The bath ratio (weight ratio of the washing solution to the clothing) was 1:1.

Figure 2:
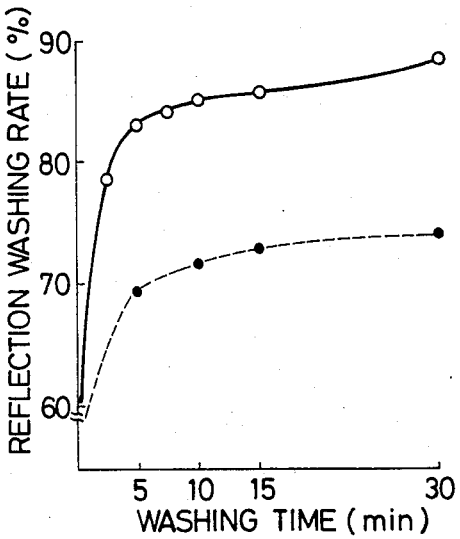
FIG. 2 and FIGS. 3A and 3B are graphs showing a washing effect of the method of the present invention and that of the conventional method.

Then, the cloth was rinsed with water by showering, followed by drying in air. A reflection washing rate was determined by measuring a surface reflectance of the cloth by means of a photoelectric reflection meter using a green filter. The result is shown as a solid line in FIG. 2.

For the sake of comparison, washing by the conventional method was conducted using a 0.17% aqueous solution of the same soap by means of a Terg-O-Tometer. The washing conditions were a bath ratio of 1:300, a temperature of 40° C., a stirring rate of 100 rpm and a treating time of 5 to 10 minutes.

The test cloth thus treated was measured by the same manner as described above to determine a reflection washing rate. The result is shown as a dotted line in FIG. 2.

As is apparent from these two graphs, a very high washing rate is obtained in the method of the present invention as compared with the conventional method.

Similarly, washing effects for dirts of proteins in epidermis stratum corneum which were difficult to remove were examined. Results are shown in the following table.

| Method of Washing | Washing Rate (%) |
|---|---|
| Foam washing (sodium palmitate) | 91.8 |
| Immersion washing | |
| Marseille soap | 70.1 |
| Phosphate containing synthetic detergent (commercially available product) | 80.2 |
| Enzyme mixed phosphate containing synthetic detergent (commercially available product) | 86.0 |
| Non-phosphate synthetic detergent (commercially available product) | 79.8 |
| Enzyme mixed non-phosphate synthetic detergent | 82.4 |

As is apparent from the above table, the method of the present invention exhibits a remarkably excellent washing effect as compared with washing by the conventional method using soap, phosphate containing synthetic detergents and non-phosphate synthetic detergents.

EXAMPLE 2

Figure 3A:
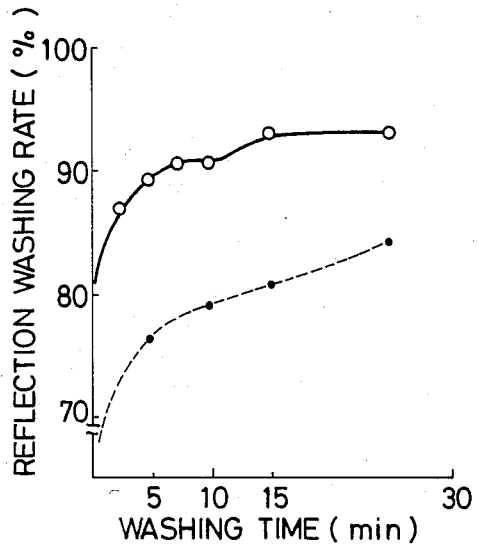
Figure 3B:
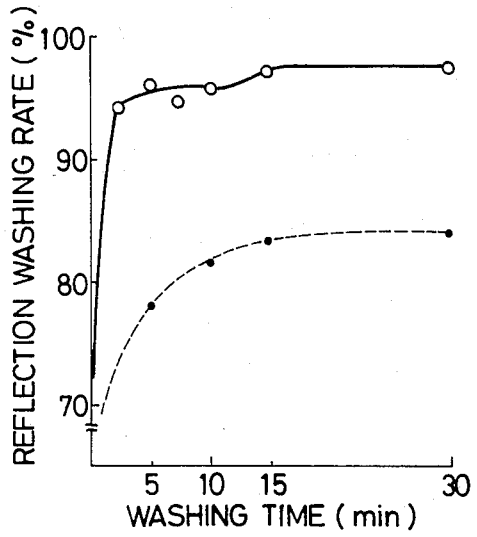

Using the same machine as in Example 1, a cloth soiled with hemoglobin was washed with foams using a 0.3% aqueous solution of sodium oleate (containing 0.05% of sodium silicate) adjusted at about 50° C., followed by rinsing and drying. A relationship between the washing time and the reflection washing rate and a relationship between the washing time and the removal rate of proteins are shown as solid lines in FIG. 3A and FIG. 3B, respectively.

Further, for the sake of comparison, results obtained by washing with the conventional method (Terg-O-Tometer; concentration of the detergent: 0.17%, bath ratio: 1:300, stirring ratio: 100 rpm, temperature: 40° C.) are shown as dotted lines.

As is apparent from comparison therebetween, the foam washing is remarkably excellent in both the reflection washing rate and the removal rate of proteins.

EXAMPLE 3

Neck-soiled cloths (naturally soiled cloth) were washed 10 times repeatedly by foam washing (0.5% solution of sodium oleate, 30 l/minute, 70° C., 10 minutes, bath ratio of 1:1) and washing by the conventional method using Terg-O-Tometer (0.17% solution of sodium oleate, 100 rpm, 40±2° C., 10 minutes, bath ratio of 1:300).

Figure 4A:
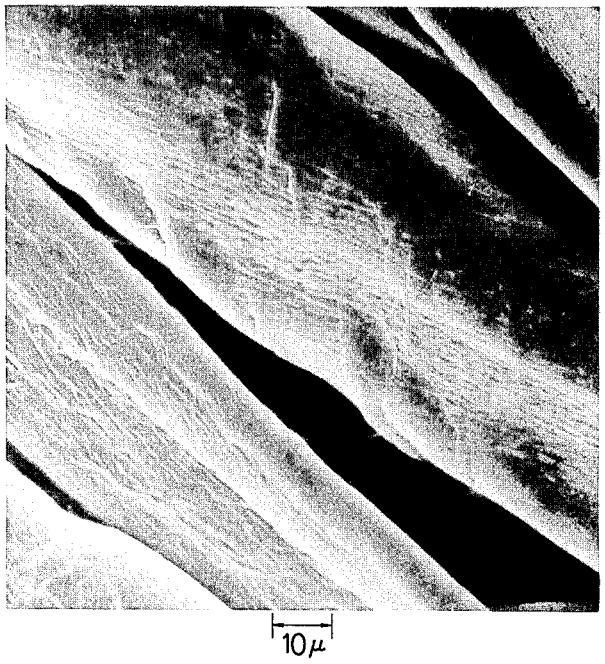
FIGS. 4A and 4B are microscopic photographs showing the state of fibers washed with the method of the present invention and that washed with the prior method.
Figure 4B:
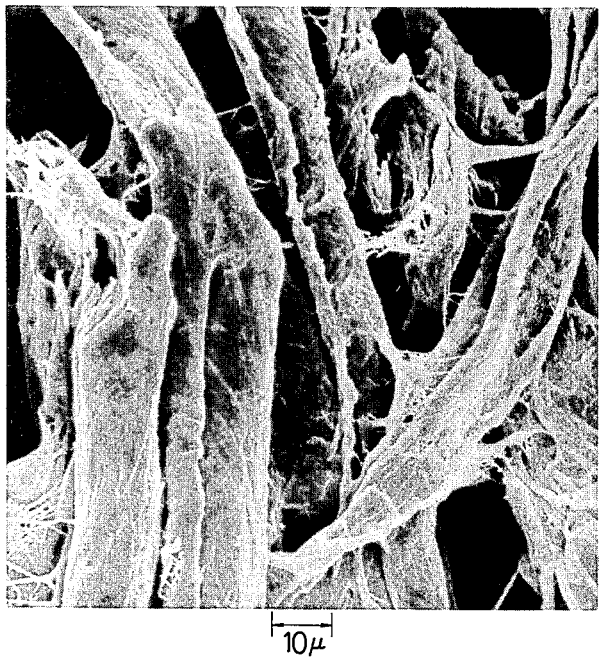

The surface state of the washed cloths was examined by a scanning electron microscope. Occurrence of fibrils on the fiber surface of the cotton cloth was not observed at all in the case of washing with foams at a low bath ratio, a high concentration and a high temperature, but fibrils were remarkably formed on the fiber surface of cotton cloth in case of washing by Terg-O-Tometer in the conventional method and collapse of fibers was partially observed, as shown in FIGS. 4A (the present invention) and 4B (conventional method).

As described above, in washing of textile goods with foams according to the method of the present invention, it is observed that damages of textile goods which are disadvantages in the conventional method are greatly improved.

EXAMPLE 4

Figure 5:
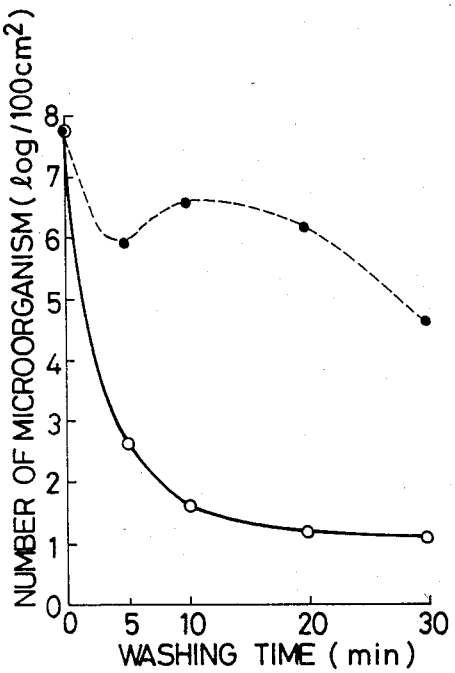
FIG. 5 is a graph showing a microbe removal effect obtained by the method of the present invention and that obtained by the conventional method.

Cloths soiled with *Escherichia coli* (standard cotton cloth: $7.4\times10^7/100\ cm^2$) were subjected to foam washing (0.5% solution of sodium oleate, 30 l/minute, 70° C., 5 to 30 minutes, bath ratio of 1:1) or washing by Terg-O-Tometer in the conventional method (0.17% solution of sodium oleate, 100 rpm, 40±2° C., 5 to 30 minutes, bath ratio of 1:300). The results obtained by examining an influence of the washing time upon a microbe removal effect on the cloth are shown in FIG. 5.

According to the results, it is observed in foam washing (solid line) that where the washing time increases, the number of microorganisms adhering to clothing rapidly reduces to show an excellent microbe removal effect. On the other hand, in washing by Terg-O-Tometer in the conventional method (dotted line) it is observed that removal of microorganisms is greatly effected within a short washing time of about 5 minutes or so, but the number of microorganisms adhering to clothing reversely increases due to resoiling by microorganisms floating in the solution when the washing time increases. However, if the washing time is further increased, it is observed that the number of microorganisms on the cloth tends to gradually decrease.

As described above, the foam washing has the advantages that a very excellent microbe removal effect is exhibited and the textile goods can maintain a sanitary effect in a high level as compared with the washing by Terg-O-Tometer in the conventional method. It is believed this is due to the fact that since the temperature of foams during washing is as high as 65° to 70° C. and microbes released by foams from the cloth are sterilized by heat during defoaming, resoiling is remarkably diminished.

While the invention has been described in detail and with reference to specific embodiments thereof, it will be apparent to one skilled in the art that various changes and modifications can be made therein without departing from the spirit and scope thereof.

What is claimed is:

1. A foam washing method which comprises forming a large amount of foam by blowing a gas through a concentrated aqueous solution of a detergent, and thereafter bringing only said foam into contact with soiled textile goods without mechanical working of said soiled textile goods to separate and remove dirt adhered to fibers of said textile goods.

2. A method of claim 1, wherein said gas is heated air.

3. A foam washing method which comprises forming a large amount of foam by blowing a gas through a concentrated aqueous solution of a detergent, bringing only said foam into contact with soiled textile goods without mechanical working of said soiled textile goods to separate and remove dirt adhered to fibers of saids textile goods, regenerating the concentrated aqueous solution of the detergent by subjecting it to a defoaming treatment, and recycling the solution for reuse.

4. A method of claim 3, wherein said gas is heated air.

5. A method of claim 3, wherein the defoaming treatment is conducted by bringing said foam into contact with a heated plate.

6. The method of claim 5 wherein said defoaming step is carried out in such a manner that said defoamed solution does not contact said soiled textile goods prior to said recycling step.

7. A method of claim 3, wherein the concentrated aqueous solution of a detergent is heated to 40° to 70° C.

8. The method of claim 3 wherein said defoaming step is carried out in such a manner that said defoamed solution does not contact said soiled textile goods prior to said recycling step.

* * * * *